United States Patent [19]

Theodores et al.

[11] 4,105,205

[45] Aug. 8, 1978

[54] RACKET

[75] Inventors: Theodore P. Theodores, Sudbury; Lewis M. Smolin, Marlboro, both of Mass.

[73] Assignee: Sudbury Engineering Corporation, Sudbury, Mass.

[21] Appl. No.: 725,404

[22] Filed: Sep. 22, 1976

Related U.S. Application Data

[63] Continuation of Ser. No. 604,238, Aug. 13, 1975, abandoned, which is a continuation of Ser. No. 469,514, May 13, 1974, abandoned.

[51] Int. Cl.[2] ..... A63B 49/08

[52] U.S. Cl. ..... 273/73 J

[58] Field of Search ..... 273/73, 75, 80 R, 80 B, 273/81 R, 81 A, 72 R, 72 A, 67 R; 172/554

[56] References Cited

U.S. PATENT DOCUMENTS

| | | | |
|---|---|---|---|
| 1,917,236 | 7/1933 | Bloomstrand | 273/73 J X |
| 2,273,120 | 2/1942 | Lindskog | 172/554 |
| 2,395,864 | 3/1946 | Geerlings et al. | 273/73 J |
| 3,461,593 | 8/1969 | Martuch et al. | 273/80 B X |
| 3,762,707 | 10/1973 | Santorelli | 273/80 B |
| 3,833,223 | 9/1974 | Shulkin | 273/80 B X |

*Primary Examiner*—Paul E. Shapiro

*Attorney, Agent, or Firm*—Norman S. Blodgett; Gerry A. Blodgett

[57] ABSTRACT

A racket for tennis and the like in which the handle is provided with one or more rotatable beams of rectangular cross section for radically changing its stiffness, and which provides for vibration damping during impact with the ball by the inclusion of a vibration damping fluid in the cavity which houses the beams.

9 Claims, 8 Drawing Figures

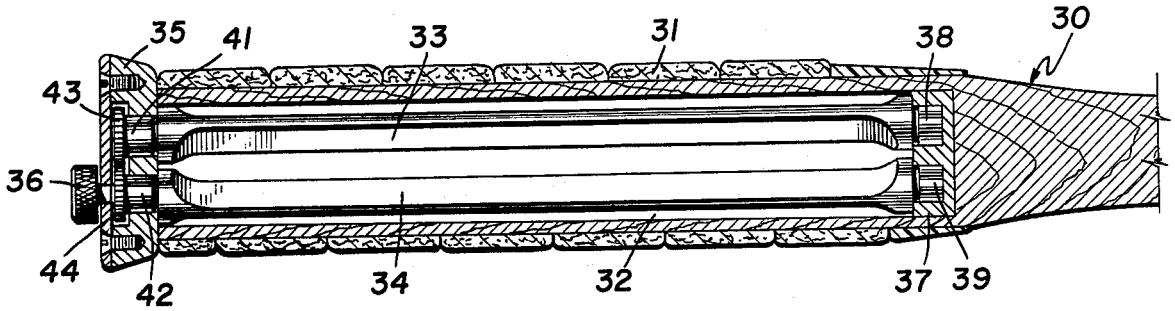
FIG. 4
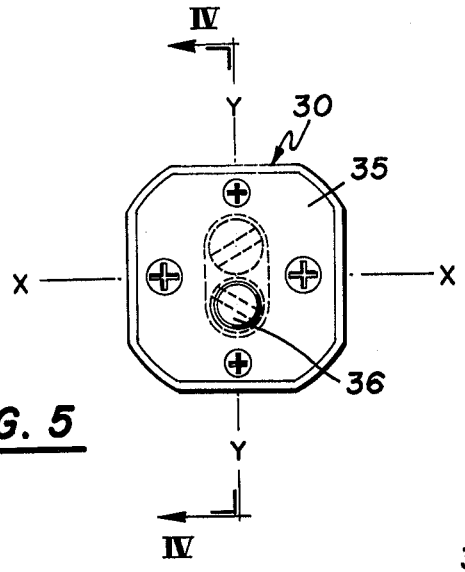
FIG. 5
FIG. 6
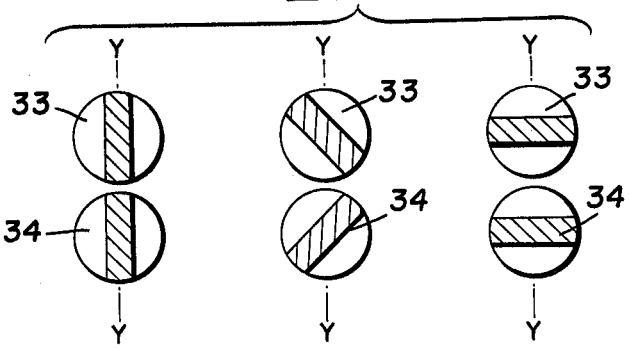
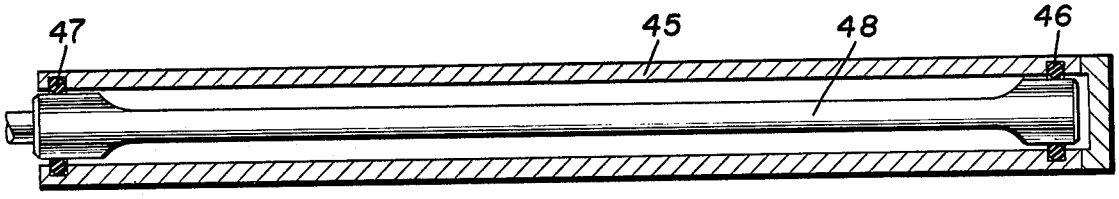
FIG. 7
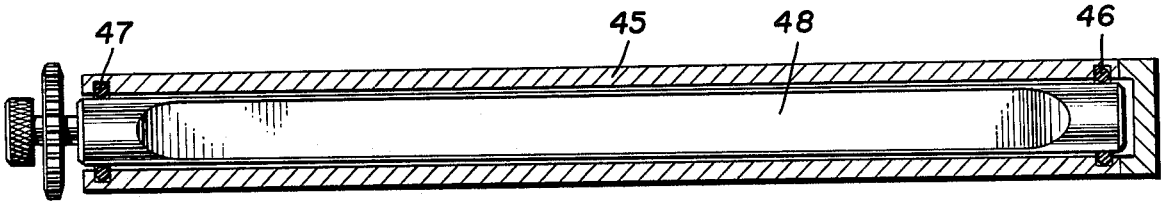
FIG. 8

RACKET

This is a continuation of application Ser. No. 604,238 filed Aug. 13, 1975, now abandoned, which is a continuation of application Ser. No. 469,514 filed May 13, 1974, now abandoned.

BACKGROUND OF THE INVENTION

In playing tennis and other racket-type games, such as squash and badminton, the stiffness or bendability of the handle plays an important role. For that reason, an expert player may have several rackets, using a different one to suit his needs in the game in which he finds himself. A tennis player, for instance, may wish a stiff handle for serving and a relatively bendable handle when he is receiving the ball. Owning and maintaining more than one racket is, of course, expensive. Furthermore, it is relatively awkward to carry more than one racket, and provide each one with adequate maintenance. At the same time, changing from one racket to another leads to the difficulty that the handles may feel differently and the strings may feel slightly different. In general, a player would rather use his "favorite" racket with all its unique characteristics than change from one racket to another. These and other difficulties experienced with the prior art devices have been obviated in a novel manner by the present invention.

It is, therefore, an outstanding object of the invention to provide a racket for tennis and the like in which a single racket is capable of having its striking characteristics changed selectively by the player.

Another object of this invention is the provision of a tennis racket or the like in which the bending moment of the handle can be readily changed.

A further object of the present invention is the provision of a tennis racket whose playing characterisitics can be radically changed during play by the player.

It is another object of the invention to provide a tennis racket in which the operation of a dial located at the end of a handle can result in the immediate selective changing of the bending characteristics of the racket.

A still further object of the invention is the provision of a tennnis racket having apparatus that permits the use of a single racket in place of several rackets of different characteristics, thus resulting in a saving in cost and convenience as well as obviating the problems inherent in owning and maintaining more than one racket.

Another object of the invention is to provide, inherently in its unique design, vibration damping characteristics which result in a smoother feel during impact and less shock effect in the player's hand and arm.

A further object of this invention is to provide a racket which will import a greater degree of its kinetic energy directly to the ball, through the effective damping of vibrations during impact, rather than the consumption of energy in vibration.

SUMMARY OF THE INVENTION

In general, the invention consists of a racket, constructed of wood or metal, having an elongated handle and a frame rigidly connected to one end of the handle. Strings are tightly mounted in the frame for engagement with a game implement and means is associated with the handle for radically changing the ability of the handle to bend and also to damp vibrations occurring during impact.

More specifically, the handle is hollow and within the cavity is carried one or more beams of greater bending moment in one direction than in a direction at right angles thereto, so that a beam is relatively stiff in the first direction and relatively flexible in the other direction. The asymmetric beam can be contained in a thin walled metal tube which is sealed for the enclosure of a viscous damping fluid.

BRIEF DESCRIPTION OF THE DRAWINGS

The character of the invention, however, may be best understood by reference to one of its structural forms, as illustrated by the accompanying drawings, in which:

FIG. 4 is a cross-sectional view of a modified form of the racket taken on the line IV—IV of FIG. 5, FIG. 5 is an end view of the modified racket, FIG. 6 is a diagrammatic showing of the characteristics of the racket shown in FIG. 4, FIG. 7 is a cross-sectional view of another modification of the racket, and FIG. 8 is a sectional view of the racket of FIG. 7 taken at a right angle thereto.

DESCRIPTION OF THE PREFERRED EMBODIMENT

Figure 1:
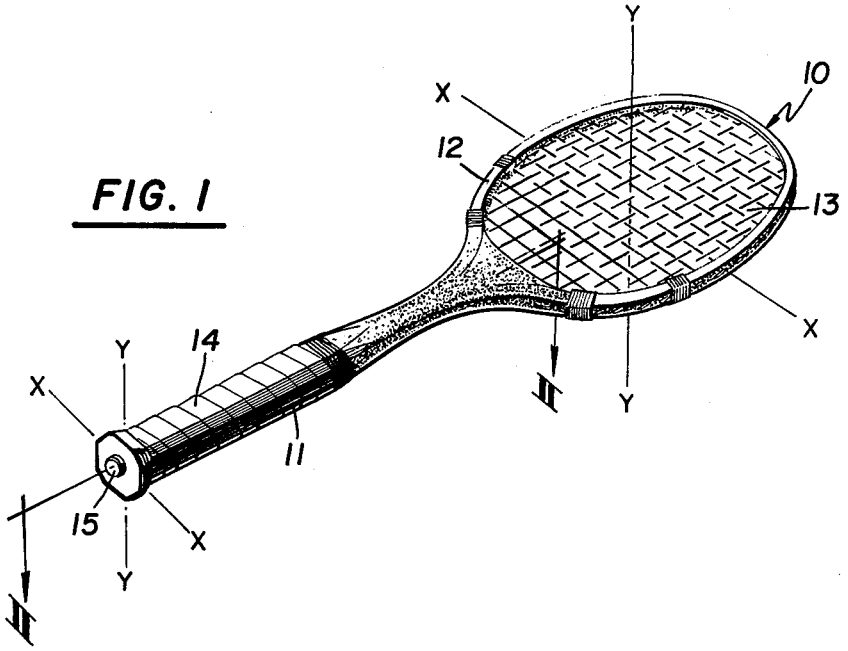
FIG. 1 is a perspective view of a wooden tennis racket embodying the principles of the present invention.

Referring first to FIG. 1, wherein are best shown the general features of the invention, the racket, indicated generally by the reference numeral 10, is shown as having an elongated handle 11 to one end of which is rigidly attached an oval frame 12. Suitably mounted in the frame are strings 13 which are tensioned for engagement with a game implement such as a tennis ball. The handle 11 is suitably wrapped with leather or the like to provide a grip 14. The end of the handle 11 opposite the end to which the frame 12 is attached is provided with a dial 15 whose purpose will be explained more fully hereinafter.

Figure 2:
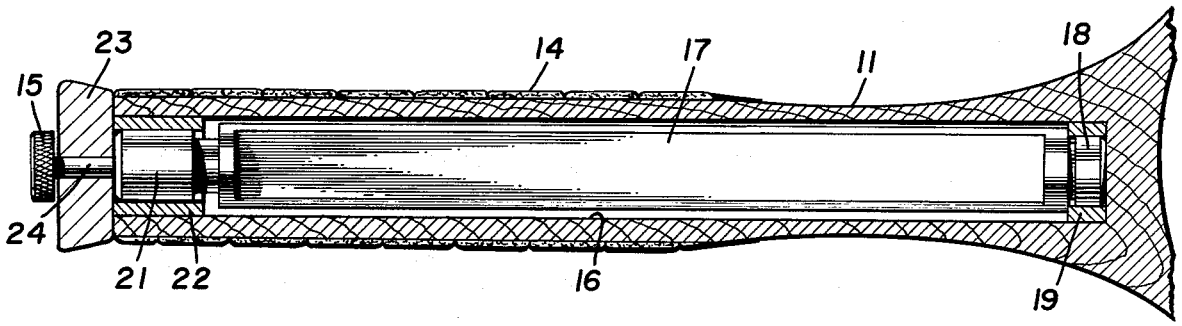
FIG. 2 is a cross-sectional view of the racket taken on the line II—II of FIG. 1.

Referring now to FIG. 2, which is a cross-sectional view of the handle 11, it can be seen that the handle is provided with one or more generally cylindrical bores or cavities 16 in which lies an elongated beam 17. The inner end of the beam is provided with a cylindrical stub shaft 18 which is rotatably carried in a bushing 19 seated at the inner end of the cavity 16. At its other end the beam 17 is provided with a stub shaft 21 carried in a bushing 22 fixedly mounted in the entrance to the cavity 16. The open end of the cavity 16 is blocked by a suitably-shaped closure 23 and through this closure extends a small shaft 24 which is integral with the stub shaft 21 and concentric therewith. The outer end of the shaft 24 carries the previously-mentioned knob 15 whose peripheral surface is serrated.

Figure 3:
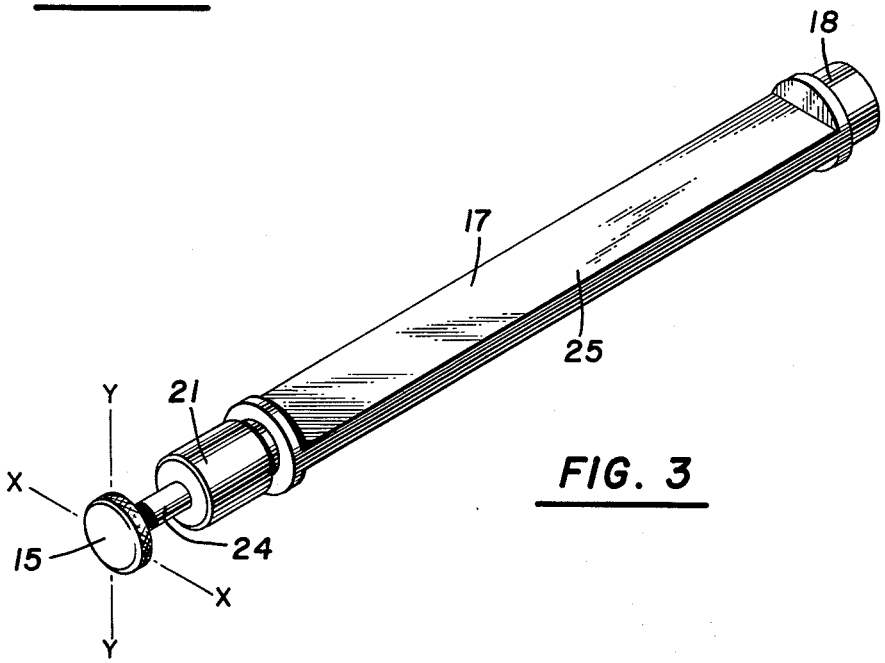
FIG. 3 is a perspective view of a beam used in he construction of the racket.

FIG. 3 is a perspective view of the beam 17 and shows many of its details. It is made up through most of its length of a central flat portion 25 of generally rectangular cross-section where the height of the cross-section is larger than its width. The central portion, therefore, has substantially different stiffness or bending moment in one direction than it does at 90°. For ease in assembly with the other elements of the racket, the knob 15 and the shaft 24 are manufactured separately from the rest of the beam but are assembled during manufacture so to be substantially integral with one another. As is obvious from an examination of FIG. 4, the main body of the beam is machined from a length of cylindrical rod. This rod may be selected from a suitable material; it may be formed of aluminum alloy to provide lightness, or it may be formed of stainless steel to give strength and durability. Naturally, a beam made from a tougher material, such as stainless steel, can be made much smaller in size than if it were formed from aluminum, while giving the same bending moment.

The operation of the tennis racket 10 will now be readily understood in view of the above description. The racket is prepared for use by first tightening the strings 13 in the well-known manner to suit the taste of the user. It is then possible to select a position of the knob 15 such that the handle 11 has either a high or a low stiffness. If the knob 15 is positioned so that the beam 17 is positioned in the manner shown in FIG. 2, so that the long dimension of the rectangular cross-section of the beam extends in the general plane of the frame 12, then the handle 11 will bend easily giving the entire racket a "loose" characteristic. If, however, the knob 15 is rotated so that the long dimension of the beam 17 extends at a right angle to the plane of the frame, then the racket will have a stiff or "hard" quality. Some tennis players like to have a stiff racket for serving and a loose racket for receiving; in the past they have been obliged to own and maintain at least two rackets having these widely different characteristics. Maintaining two such tennis rackets is not only expensive and time consuming, but the player that uses two such rackets will probably find that other characteristics of the racket are different. For instance, they may have slightly different string tensions no matter how hard he tries to make them alike, or they may have different weights. So, in shifting from one to the other, it is true that he obtains rackets of different stiffness, but he also is shifting from one racket to another and these other qualities may also differ. This will tend to offset the advantages of having two rackets of different stiffness. By use of the present invention, the only characteristic that is changed is the stiffness. The weight, string tension, and other parameters of the racket remain the same.

FIGS. 4, 5 and 6 show a modified form of the invention. the racket 30 is provided with a handle 31 having an elongated cavity 32. Located in the cavity and rotatable about the space parallel axes are two beams 33 and 34. The end of the handle 31 is provided with a closure 35 extending over the open end of the cavity 32 and mounted externally of the closure is a knob 36. Located on the inner end of the recess 32 is a bearing member 37 having two spaced parallel bores which receive stub shafts 38 and 39 extending from the adjacent ends of the beams 33 and 34, respectively. The outer ends of the beams 33 and 34 carry similar stub shafts 41 and 42, respectively, which reside in suitable bores in the closure 35. The outer ends of the stub shafts 41 and 42 carry gears 43 and 44 which mesh so that rotation of the knob 36 and subsequent rotation of the beam 34 produces a similar and equal rotation of the beam 33.

FIG. 6 shows clearly the manner in which the rotation of the beams 33 and 34 can be used to change the relative stiffness of the handle 31. The line Y—Y is used to indicate a line perpendicular to the plane of the frame and strings of the racket. The position of the beams 33 and 34 shown at the left-hand side of FIG. 6 gives the stiffest possible condition of the handle 31. On the other hand, in the right-hand situation, where the long dimensions of the beams are spaced and parallel, the weakest condition results. The center position, where the beams are at acute angles to the Y—Y, gives an intermediate degree of stiffness.

FIGS. 7 and 8 show a still further beam construction in which a racket handle 45 is provided with a beam 46. The beam 46 is simply made from a rod by carving flats on either side of the rod, the portions of the rod which are untouched acting as the bearing surfaces. At the inner end the beam 46 is supported in an O-ring 46 formed of Teflon or the like, while the outer end is supported in an O-ring 47. FIG. 7 shows one position of the beam, while FIG. 8 shows a position at a 90° situation. The cavities and clearances 49 are filled with a viscous damping fluid such as silicone fluid or the like.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A racket, comprising (a) an elongated handle, within which is provided a longitudinally-extending cavity, (b) a frame rigidly connected to one end of the handle, (c) strings tightly mounted in the frame for engagement with a game implement, and (d) means associated with the handle and mounted in the cavity for radically changing the ability of the handle to bend, the means including at least two beams each being provided in the cavity for rotation about spaced parallel axis and gears being provided and adapted to connect the beams together for synchronous rotation, each beam having a different bending moment in one plane than in another, having a generally rectangular cross-section, the handle having a knob located at its other end, which knob is connected to the beam to produce a rotation thereof within the cavity about an axis extending longitudinally of the handle, each end of each beam being provided with a stub shaft and a bearing mounted in the cavity to carry each stub shaft.

2. A racket as recited in claim 1, wherein a viscous damping fluid is provided and the beams are contained in thin metal tubes which are sealed for the enclosure of the viscous damping fluid for reducing vibration after impact with the game implement.

3. A racket as recited in claim 1, wherein each beam is formed by machining flats on opposite sides of a metal rod for substantially its entire length.

4. A racket as recited in claim 1, wherein damping means is associated with the handle for providing for vibration damping.

5. A racket, comprising (a) an elongated handle, (b) a frame rigidly connected to one end of the handle, (c) strings tightly mounted in the frame for engagement with a game implement, and (d) means associated with the handle for radically changing the ability of the handle to bend, wherein the handle is provided with a longitudinally-extending cavity in which the said means is carried and which is provided with a viscous damping fluid, the said means consisting of a beam which has a different bending moment in one plane than in another, the beam having a generally rectangular cross-section, and wherein the handle has a knob located at the other end, which knob is connected to the beam to produce a rotation thereof within the cavity about an axis extending longitudinally of the handle, the beam being contained in a thin metal tube which is sealed for the enclosure of the viscous damping fluid for reducing vibration after impact with a ball.

6. A racket, comprising (a) an elongated handle within which is provided a longitudinally-extending cavity, (b) a frame rigidly connected to one end of the handle, (c) strings tightly mounted in the frame to define a striking surface for engagement with a game implement, (d) two beams, each beam being mounted in and extending lengthwise of the cavity for radically changing the ability of the handle to bend, each beam having a cross-section which is generally rectangular cross-section, so that it has a different bending moment in one plane than in another, each beam being held at each end in the cavity so as to be capable of rotation on occasion about a line extending longitudinally of the handle but not capable of lateral movement, and (e) means for rotating each beam on occasion to change its bending moment relative to a plane passing through the said line and perpendicular to the striking surface of the head, a knob connected to the beams to produce a rotation thereof within the cavity about an axis extending longitudinally of the handle, each end of each beam is provided with a stub shaft, and a bearing mounted in the cavity to carry each stub shaft.

7. A racket as recited in claim 6, wherein a viscous damping fluid is provided and the beams are contained in thin metal tubes which are sealed for the enclosure of the viscous damping fluid for reducing vibration after impact with the game implement.

8. A racket as recited in claim 6, wherein each beam is formed by machining flats on opposite sides of a metal rod for substantially its entire length.

9. A racket as recited in claim 6, wherein damping means is associated with a handle for providing for vibration damping.

* * * * *